United States Patent [19]

Nichols

[11] Patent Number: 4,625,885

[45] Date of Patent: Dec. 2, 1986

[54] CONTROLLED-RELEASE SECURITY BAND FOR STERILIZATION CONTAINER

[76] Inventor: Robert L. Nichols, 808 Fort Worth, Jacksonville, Tex. 75766

[21] Appl. No.: 842,113

[22] Filed: Mar. 20, 1986

[51] Int. Cl.[4] ..... B65D 53/00; B65D 55/02

[52] U.S. Cl. ..... 220/214; 220/324; 422/119

[58] Field of Search ..... 220/214, 324; 422/300, 422/26, 119, 310; 292/318, 322

[56] References Cited

U.S. PATENT DOCUMENTS 3,952,869 4/1976 Sansom ..... 220/214

4,562,047 12/1985 Sestak et al. ..... 220/214

*Primary Examiner*—George T. Hall

*Attorney, Agent, or Firm*—Jerry W. Mills; Gregory M. Howison

[57] ABSTRACT

A security system for a sterilization container (10) comprises a first member (18) and a second member (24) of a clamp (16). The first member (18) is adjacent to the second member (24) when the container (10) is closed, and is in a position spaced from the second member (24) when the container (10) is open. A non-stick surface (28) is formed on the first member (18) on an area remote from the second member (24) when the first and second members are adjacent. A security band (30) is placed around portions (22, 26) of the first and second members (18, 24) while they are adjacent, the band (30) shrinking during a sterilization treatment of the container (10) to bind the first member (18) to the second member (24). The band (30) releases from the first member (18) when the second member (24) is moved to a position spaced from the first member (18).

9 Claims, 6 Drawing Figures

CONTROLLED-RELEASE SECURITY BAND FOR STERILIZATION CONTAINER

TECHNICAL FIELD

The present invention pertains to sterilization containers and more particularly to security bands for medical instrument sterilization containers.

BACKGROUND OF THE INVENTION

Most medical instrument sterilization containers use some form of security device to give evidence of sterile integrity prior to use. One such device is a shrink band that is placed around a pair of tabs that separate when the container is opened. The band is placed around the pair of tabs loosely, but the band shrinks onto the tabs when the container goes through heat sterilization. It is thereafter necessary to break the band in order to open the container.

Several problems have arisen in the use of these security bands. The bands are conventionally made out of expanded polypropylene, which has a natural inclination to stick to metal when it shrinks. When the band breaks, a broken portion sometimes sticks to one of the tabs in an inaccessible location. Sometimes the band will break in several pieces, also causing an inconvenience.

Release agents coating the band have conventionally been provided in order to prevent the band from sticking onto the tabs. These release agents are in the nature of lubricants, such as oil, silicone or other substances. The release agents can either be applied to coat the outside of the band or can be formulated into the band polypropylene mixture to eventually be sweated out onto the surface of the band.

In addition to increased cost, these release agents cause problems in that the band will be totally released from the container, and may shoot through the air like a rubber band and enter an operating "sterile theater". Since the band is disposed on the outside of the container, it is contaminated, and thus it is hazardous to introduce it in an uncontrolled way into a sterile environment.

In view of the problems with conventional security bands, there exists a need for a security band that has a controlled release and which will adhere to an easily accessible portion of the container so that it can be easily removed.

SUMMARY OF THE INVENTION

The present invention comprises a security system for a sterilization container, including a first member of a clamp that is connected via a hinge element to a second member of the clamp. A first tab is formed on the first member and mates with a second tab formed on the second member when the clamp is in a closed or clamped position. The first tab has a non-stick surface at least on a side opposed to the side mating with the second tab. A polypropylene band is heat-shrunk around the tabs during the sterilization process, binding the first and second tabs together. When it is desired to open the container, the polypropylene band releases from the first tab by sliding off of the non-stick surface, but adheres in one piece to the second tab in order to prevent its propulsion into a sterile environment. Since the second tab is more easily accessible than the first tab, the broken band may be easily removed prior to the next sterilization cycle.

BRIEF DESCRIPTION OF THE DRAWINGS

For a more complete understanding of the present invention and the advantages thereof, reference is now made to the following description taken in conjunction with the drawings in which.

DETAILED DESCRIPTION OF THE INVENTION

Figure 1:
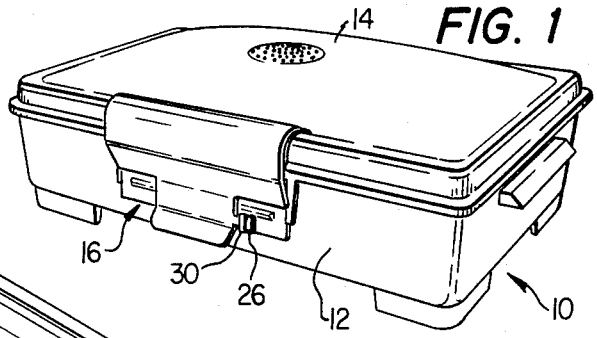
FIG. 1 is a perspective view of a medical instrument sterilization container incorporating the invention.

Referring to FIG. 1, a perspective view of a medical instrument sterilization container 10 is shown. Container 10 has a body 12 in which medical instruments are placed. A lid 14 is sealably clamped to body 12 by a pair of clamps 16 (one shown).

Figure 2:
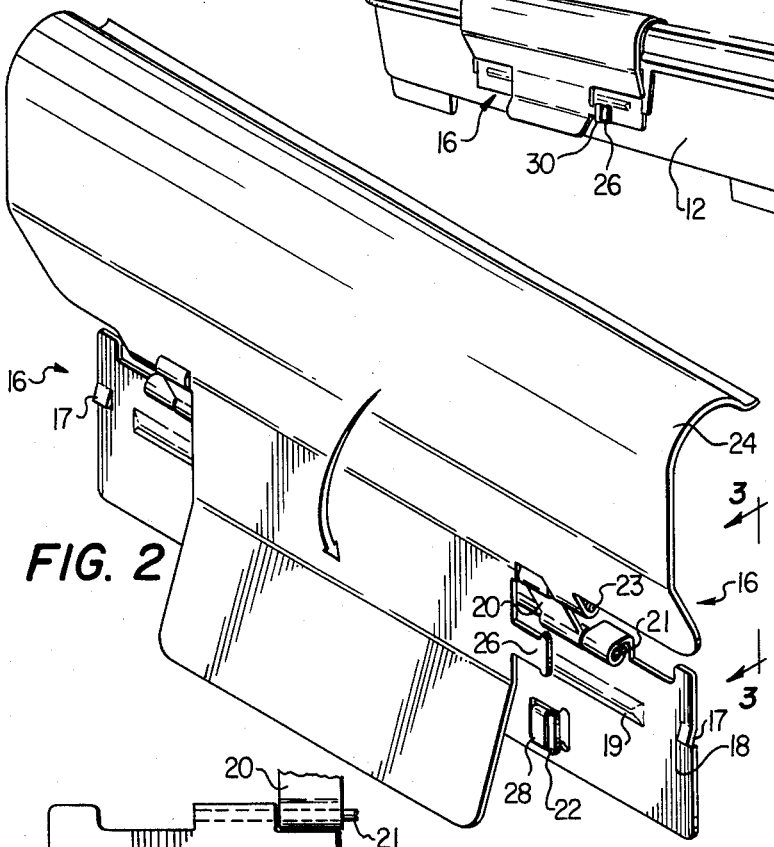
FIG. 2 is an enlarged isometric view of a clamp for the medical instrument sterilization container shown in FIG. 1.

Referring now to FIG. 2, a clamp 16 is illustrated in more detail. Clamp 16 has an inner member or plate 18 that is affixed to body 12. Inner member 18 can be affixed to body 12 by snapping it into a preformed pocket in the side of body 12. A flange 17 and a projection 19 are formed on inner member 18 to resist extraction of member 18 from the pocket.

Plate 18 is hingedly connected to a hinge element 20 via a pin 21. An inner or first tab 22 is formed on plate 18, as by stamping, to be slightly raised from the general surface of plate 18. Hinge element 20 is hingedly connected via a pin 23 to an upper plate or member 24. Upper plate 24 has an outer or second tab 26 formed thereon that is adapted to be mated with first tab 22. FIG. 2 shows clamp 16 in the open position, and in this position tab 22 is spaced apart from tab 26.

Clamp 16 seals lid 14 to body 12 by having its upper plate 24 lowered around hinge element 20 and pins 21 and 23 and then clamped into place, such that pin 23 is lower than pin 21. When clamp 16 is in this closed position, tab 26 mates with tab 22. Clamp 16 is preferably formed out of a metal which is impervious to sterilization environments, such as stainless steel.

Figure 3:
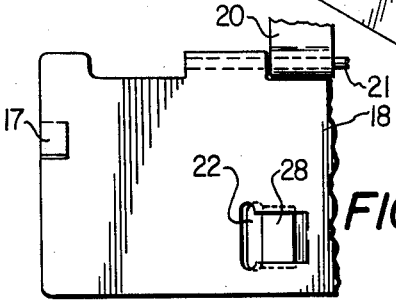
FIG. 3 is a detail of the reverse side of a lower member of the clamp shown in FIG. 2, showing the reverse side of a tab formed on the lower member.

Turning now to FIG. 3, a detail of the reverse surface of plate 18 is illustrated, also showing the reverse surface of tab 22. Tab 22 has, at least on its reverse side, a non-stick surface 28 that is preferably formed of teflon. Teflon surface 28 may be conveniently formed by heat-shrinking an extruded and cut tube of teflon material onto tab 22. Alternate methods of affixing non-stick surface 28 to tab 22 exist, such as applying a teflon powder and sintering plate 18. Other non-stick surfaces such as nylon may also be employed.

Figure 4:
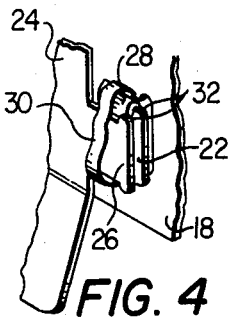
FIGS. 4–6 are details of the clamps shown in FIG. 2, showing the cooperation of an upper tab, a lower tab and a security band during succeeding stages of the sterilization container's use.
Figure 5:
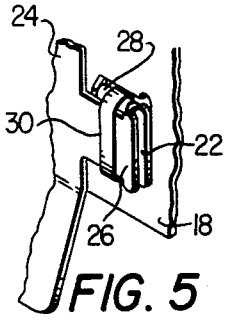
Figure 6:
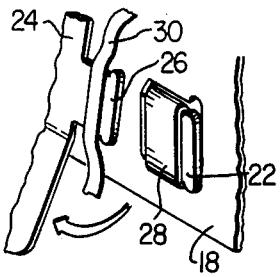

FIGS. 4–6 are details of clamp 16 showing the interaction of tab 22, tab 26 and a security band 30 at various stages of use of the sterilization container. Security band 30 is preferably made of polypropylene. In order to fabricate security band 30, a tube of polypropylene is extruded and is blown to several times the extruded diameter. The tube is then sliced into bands.

In operation, the medical instruments to be sterilized are placed inside of body 12, and lid 14 is clamped in place with the aid of a pair of clamps 16. In order to clamp lid 14 to body 12, each clamp 16 is lowered into its clamped or closed position so that tab 22 will mate with and be adjacent to tab 26. As shown in FIG. 4, security band 30 is then placed over and around tabs 22 and 26. A pair of ears 32 on each tab 22 and 26 keeps security band 30 in place before container 10 can be subjected to a sterilization treatment. It is preferred that a like security band 30 be placed on the other clamp used to clamp the sterilization container.

The medical instruments are sterilized under either an atmosphere of steam or an atmosphere of ethylene oxide, generally at the temperature of 252 Degrees Fahrenheit. It has been determined that the security band of the invention will work anywhere in the usual sterilization range of 252 to 290 Degrees Fahrenheit.

FIG. 5 illustrates the tabs 22 and 26 and security band 30 after container 10 has been subjected to a sterilization treatment. After the sterilization treatment has been completed, security band 30 has been heat-shrunk to tightly bind tab 22 to tab 26. In this condition, the contents of container 10 are secure from unnoticed contamination, as the container may not be opened without breaking the band 30.

FIG. 6 illustrates what happens when plate 24, and therefore tab 26, is pulled away from plate eighteen and tab 22. As tab 26 becomes more and more spaced apart from tab 22, the tension placed on security band 30 increases until band 30 breaks. After security band 30 breaks, it will slide off of non-stick surface 28, but will continue to adhere to tab 26. In this manner, an uncontrolled release of a band 30 away from container 10, and into a possibly sterile theater, is prevented. Further, since the entirety of band 30 sticks to the front surface of tab 26, the broken band 30 may be easily removed before replacement during the next sterilization treatment cycle. In subsequent sterilization cycles, further, intact security bands 30 are used.

In summary, a sterilization container security system has been disclosed that prevents an uncontrolled release of a security band into a possibly sterile area. While the container is closed, a first member is adjacent to a second member, and a security band is placed around portions or tabs of the two members. During the sterilization treatment, the band shrinks into place, binding the two tabs together. Since one of the tabs has a non-stick surface, the band will stick only to the other tab when the container is opened, facilitating easy removal of the broken band.

Although a preferred embodiment of the invention has been described in detail, it should be understood that various changes, substitutions, and alterations can be made therein without departing from the spirit and scope of the invention as defined by the appended claims.

What is claimed is:

1. A security system for a sterilization container, comprising:

a first member and a second member associated with the container, said first member positioned adjacent to said second member when said container is closed, said second member moved to a position spaced from said first member when said container is open;

a non-stick surface on said first member formed at least on an area remote from said second member when said first and second members are adjacent;

a band for being placed around portions of said first and second members while they are adjacent, said band shrinking during a sterilization treatment of said container to bind said first member to said second member;

said band releasing from said first member when said second member is moved to said position spaced from said first member.

2. The security system of claim 1, wherein said non-stick surface comprises teflon.

3. The security system of claim 1, wherein said band comprises polypropylene.

4. A clamp for a sterilization container, comprising:

a first member hingedly connected to a second member;

a first tab formed on said first member and mating with a second tab on said second member while said first and second members are in a clamped position, said first and second tabs spaced apart when said first and second members are in an unclamped position;

security means disposed to bind said first tab to said second tab in the clamped position, said first tab having a non-stick surface at least on a side opposed to a side adjacent said second tab;

said security means releasing from said first tab and adhering to said second tab when said first and second members are moved to said unclamped position.

5. The clamp of claim 4, wherein said tabs are formed of metal.

6. The clamp of claim 4, wherein said non-stick surface comprises teflon.

7. The clamp of claim 6, wherein said non-stick surface is formed by an extruded and cut tube of teflon material heat-shrunk onto said first tab.

8. The clamp of claim 4, wherein said security means comprises a heat shrinkable band and said tabs have widening flanges at their free ends to loosely retain said band before it is heat-shrunk in place.

9. A method for safeguarding the sterility of a sterilization container, comprising the steps of:

placing instruments to be sterilized into a container;

closing the container with a lid;

sealing the container and the lid with a clamp;

forming a non-stick portion on a portion of the clamp to prevent the security band from sticking to the portion;

placing a security band on the clamp;

shrinking the band during a sterilization treatment to maintain the clamp in the desired clamping position;

pulling the clamp when it is desired to open the container; and breaking the band such that the band will not adhere to the non-stick surface but will adhere to an accessible portion of the clamp.

* * * * *